United States Patent [19]

Bayless et al.

[11] Patent Number: 4,967,057

[45] Date of Patent: Oct. 30, 1990

[54] SNOW MELTING HEATER MATS

[76] Inventors: Ronald E. Bayless, 34 Gala Pl., Pagosa Springs, Colo. 81147; James M. Havard, 12067 W. 62nd Ave., Arvada, Colo. 80004

[21] Appl. No.: 227,109

[22] Filed: Aug. 2, 1988

[51] Int. Cl.[5] ..... H05B 3/36

[52] U.S. Cl. ..... 219/213; 439/281; 219/549; 392/435

[58] Field of Search ..... 219/213, 345, 528, 549; 439/281

[56] References Cited

U.S. PATENT DOCUMENTS

| | | | |
|---|---|---|---|
| 1,062,199 | 5/1913 | Stephenson | 219/213 |
| 1,349,136 | 8/1920 | Lillard | 219/213 |
| 1,632,651 | 6/1927 | Hubbard | 219/528 |
| 2,052,644 | 9/1936 | Murphy | 219/528 |
| 2,138,217 | 11/1938 | Sutter | 219/345 |
| 2,231,251 | 2/1941 | Chaney | 219/528 |
| 2,406,867 | 8/1946 | Griffith et al. | 244/134 |
| 2,497,998 | 2/1950 | Lee | 219/544 |
| 2,521,540 | 9/1950 | Richardson | 219/345 |
| 2,612,585 | 9/1952 | McCann | 219/345 |
| 2,624,023 | 7/1952 | Messiah | 94/33 |
| 2,745,942 | 5/1956 | Cohen | 219/528 |
| 2,762,896 | 9/1956 | Pendleton | 219/539 |
| 2,795,683 | 6/1957 | Teiger | 219/213 |
| 2,816,201 | 12/1957 | Mulvey | 219/345 |
| 2,834,862 | 5/1958 | Meyers | 219/528 |
| 2,844,696 | 7/1958 | Custer | 219/345 |
| 2,845,519 | 7/1958 | Willat | 219/549 |
| 2,889,439 | 6/1959 | Musgrave | 219/345 |
| 2,912,555 | 11/1959 | Jamison | 219/345 |
| 3,047,701 | 7/1962 | Frungel | 219/213 |
| 3,095,491 | 6/1963 | Deacon | 219/345 |
| 3,152,313 | 10/1964 | Barbour et al. | 338/214 |
| 3,166,371 | 1/1965 | Brown | 439/281 |
| 3,193,664 | 7/1965 | Beery | 219/549 |
| 3,209,128 | 9/1965 | Chapman | 219/528 |
| 3,236,991 | 2/1966 | Graham et al. | 219/213 |
| 3,244,858 | 4/1966 | Thorpe | 219/345 |
| 3,260,835 | 7/1966 | Soukey et al. | 219/213 |
| 3,281,578 | 10/1966 | Chapman | 219/528 |
| 3,410,984 | 11/1968 | Sandford | 219/212 |
| 3,445,628 | 5/1969 | Bateman | 219/345 |
| 3,454,746 | 7/1969 | Dubois | 219/345 |
| 3,521,029 | 7/1970 | Toyooka et al. | 219/201 |
| 3,598,960 | 8/1971 | Deacon | 219/345 |
| 3,603,764 | 9/1971 | Martin | 219/213 |
| 3,626,149 | 12/1971 | Carney | 219/213 |
| 3,637,975 | 1/1972 | Eilhardt | 219/213 |
| 3,657,516 | 4/1972 | Fujihara | 219/345 |
| 3,659,338 | 5/1972 | McFarlane | 29/611 |
| 3,686,472 | 8/1972 | Harris | 219/213 |
| 3,806,702 | 4/1974 | Spencer | 219/528 |
| 3,812,320 | 5/1974 | Borgren | 219/213 |
| 3,861,029 | 1/1975 | Smith-Johansen et al. | 29/611 |
| 3,993,122 | 11/1976 | Svenstam | 165/45 |
| 4,069,410 | 1/1978 | Keep | 219/535 |
| 4,188,276 | 2/1980 | Lyons et al. | 204/159.17 |
| 4,242,573 | 12/1980 | Batliwalla | 219/528 |
| 4,318,881 | 3/1982 | Sopory | 264/346 |
| 4,388,607 | 6/1983 | Toy et al. | 338/22 SD |
| 4,426,339 | 1/1984 | Kamath et al. | 264/22 |
| 4,459,473 | 7/1984 | Kamath | 219/553 |
| 4,560,498 | 12/1985 | Horsma et al. | 252/511 |
| 4,564,745 | 1/1986 | Deschenes | 219/213 |
| 4,574,186 | 3/1986 | Sakai | 219/345 |

FOREIGN PATENT DOCUMENTS

| | | | |
|---|---|---|---|
| 838497 | 6/1960 | United Kingdom | 219/528 |

*Primary Examiner*—Teresa J. Walberg
*Attorney, Agent, or Firm*—Kenton L. Freudenberg; Maxwell C. Freudenberg

[57] ABSTRACT

Individual electrically heated mats, self-regulated by use of an electrical element whose resistance varies proportionately with its temperature, used for covering walking areas to prevent accumulation of snow and ice. Each mat is provided with male and female electrical connections on the ends of short power cords to permit any number of mats to be chained together in electrical parallel and to be used to cover, for example, a flight of stairs by positioning one mat on each stair.

21 Claims, 5 Drawing Sheets

SNOW MELTING HEATER MATS

BACKGROUND OF THE INVENTION

In areas of high snowfall, accumulated snow presents an obvious hazard in areas where people walk. While removal of the snow is possible, as snow continues to fall even a minimal accumulation after an area has been cleared can create a dangerous slippery surface. Furthermore when snowfall is heavy enough that the use of machinery such as ordinary snow blowers is desirable, such machinery can rarely be operated on stairways. In such a situation, often an ordinary snow shovel is the only method by which such snow can be removed. The ideal solution is to have a device which can prevent the accumulation of ice and snow of any amount and which can be installed and used in a simple manner. While heated walkways have been known and used for some time, they are generally installed as permanent fixtures, are relatively expensive to install and operate and are not readily adapted to previously existing stairs and walkways.

SUMMARY OF THE INVENTION

The present invention relates to individual heater mats for use in covering walking areas, especially stairways, in locations subject to heavy snowfall. The mats are electrically heated with a self regulating heat wire and can be electrically connected together to provide a heated surface of almost any size upon which falling snow is melted and does not accumulate. The heating elements of the mats are electrically connected in parallel so that the failure of one mat unit will not prevent the other mats connected thereto from functioning. By using self regulating heater elements, the mats eliminate the need for any additional thermostatic controls. The mats are constructed in a manner such that any number of them can be used for the purpose of covering a length of walkway, or a set of stairs can be covered by positioning a single mat on each step. The electrical connection between the mats is made weatherproof and is positioned, for instance, between steps to minimize both corrosion of the connectors and the danger of any electrical shock or short circuiting under the wet conditions where the mats would be used. The positioning of the electrical connectors is to the side when the mats are used on a flat surface or suspended between steps when the mats are used on a stairway to minimize interference with foot traffic, thus minimizing the problem of inadvertently disconnecting the electrical circuit or having a person trip on the power cords.

It is an object of the present invention to provide a snow melting heater mat which is economical to operate and is readily adaptable to use in a variety of situations.

It is also an object of the present invention to provide a simple snow melting mat which requires no independent thermostatic or other control means.

It is another object of the present invention to provide a snow melting mat of simple construction, a number of which can be connected together electrically and which can be inverted in position to account for the position of an appropriate electrical receptacle without affecting the function of weatherproof electrical connectors between mats.

It is a further object of the present invention to provide electrically connectable snow melting mats in which the failure as an electrical conductor of the heating element of one mat will not affect the other mats to which it is connected.

It is a still another object of the present invention to provide a configuration of snow melting mat which will allow the greatest efficiency in the functioning of a self regulating heating element by selectively transferring its heat output to its upper surface and, correspondingly, to the snow or ice to be melted.

DESCRIPTION OF THE PREFERRED EMBODIMENT

Several heating mats are arranged on the steps and walkway for keeping these areas clear of snow and ice. The heating elements of these heaters are all connected in parallel by cords which allow the heaters to be connected to a power source at one point but allowing the heaters to be connected successively to each other.

The mats are each approximately 10 by 20 inches in area and may be made very thin, as little as one half to three quarters of an inch in thickness, the heating elements and grounding layers described herein being not more than about one quarter inch in thickness and the rest of the thickness being in the casing and the knobby protuberances thereon.

Figure 1:
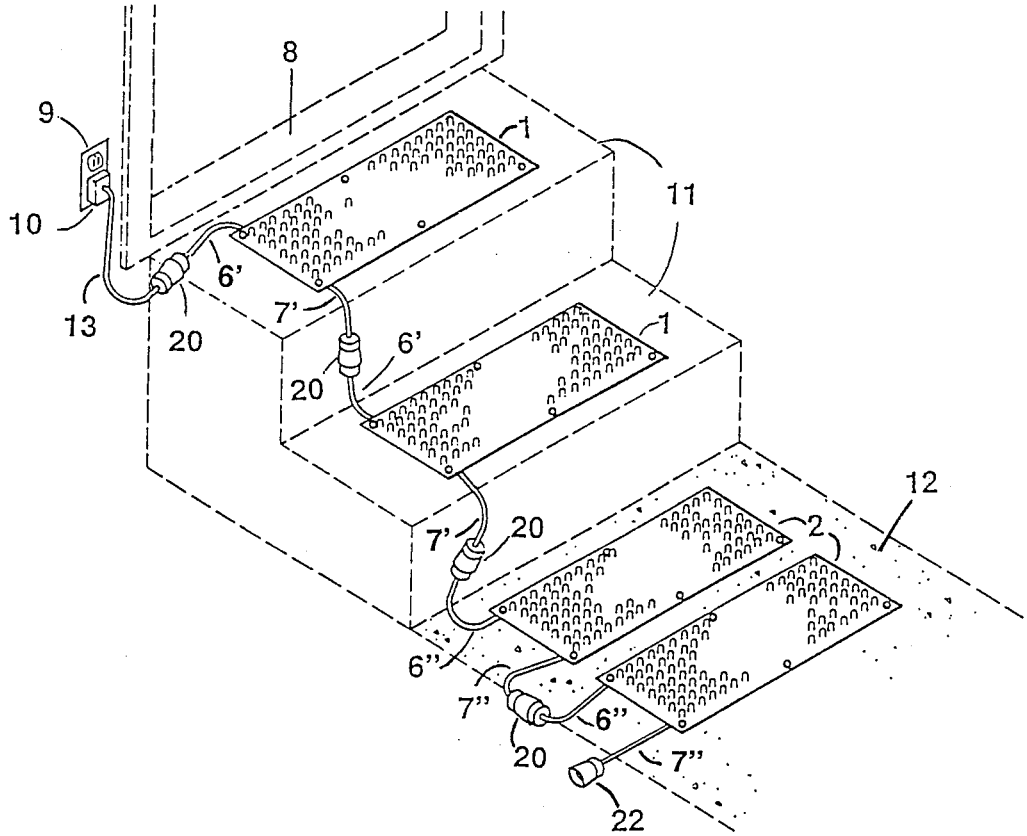
FIG. 1 shows several number of the units of the preferred embodiment as they can be positioned in use on both a stairway and a flat walkway.
Figure 2:
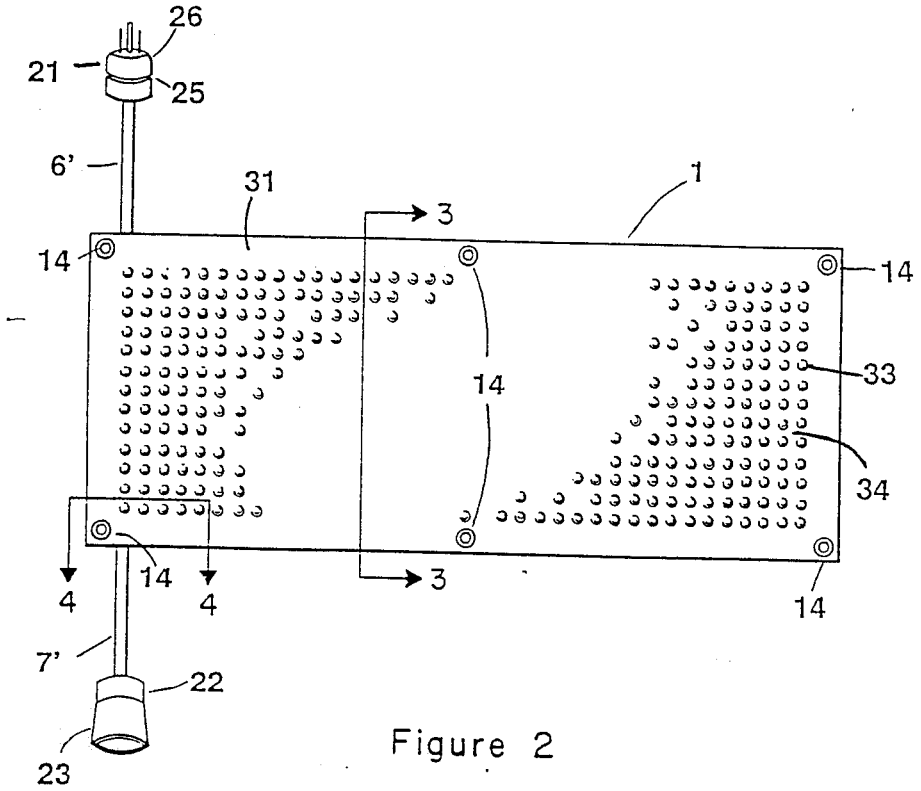
FIG. 2 is a plan view of a single mat of the preferred embodiment.

As seen in FIG. 1 the two heating mats 1 on the two steps of the stair 11 each have the electric cords 6, and 7, therefore extending from the longitudinal sides near one end thereof. The two heating mats 2 on the flat walkway surface 12 each have the electric cords 6″ and 7″ extending from one end near the sides thereof. Each of these cords has a portion which enters an edge of the casing of its respective mat near or close to one of the corners of the rectangular casing and each entry portion of these cords extends externally from the respective casing generally coplanar with the flat mat. In each mat these corners are at one end of the mat but at opposite longitudinal sides of the mat. The cord 6' or 6" nearest the door sill 8 for each of these mats has a male electric plug 21 thereon for connection to a suitable power source or the next preceding mat, preferably in a circuit having ground fault interruption (GFI) protection to minimize shock hazards during use of the mats in an outdoor wet environment resulting from melted snow around the mat.

Figure 7:
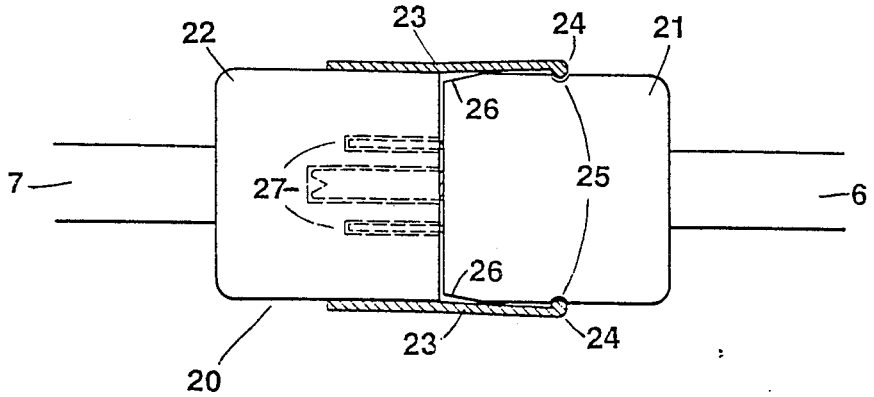
FIG. 7 is a cross section of the watertight and weatherproof electrical connector used between individual mats.

The other cord 7' or 7" for each heating mat near the side thereof remote from the door sill 8 has at the end thereof a female electrical connector 22 having a resilient or elastic skirt 23 attached thereto as seen in detail in FIG. 7 with an inwardly extending annular bead 24 arranged to fit tightly on the surface of the male plug 21 or in an annular recess 25 in the outer surface thereof to make the electrical connection at each female connector watertight and weatherproof. A plurality of heaters are connected in electrical parallel by means of the wires 54 which pass from one power cord to the other within the mat. The last mat remote from the power source may have its female connector 22 plugged with a dummy male plug, not shown, to keep water and debris out of the otherwise exposed terminals. As seen in FIG. 1, the cords with the female connectors 7' and 7" have a length such that the fastened weatherproof electrical connection 20 hangs midway between one step surface and the next lower step or walkway surface so that the bell-shaped skirt 23 on the female portion 22 of the connector opens downwardly to shed water and keep it from entering the terminal area of this connector. The receptacle 9 adjacent the door sill 8 is preferably a three-conductor GFI protected weatherproof receptacle. A three-conductor extension cord 13 with weatherproof connectors like those on the mat cords is preferably used to connect the first mat's male connector to the power source and may incorporate a plug-in GFI device 10 in situations where the wall receptacle has no GFI protection.

Figure 3:
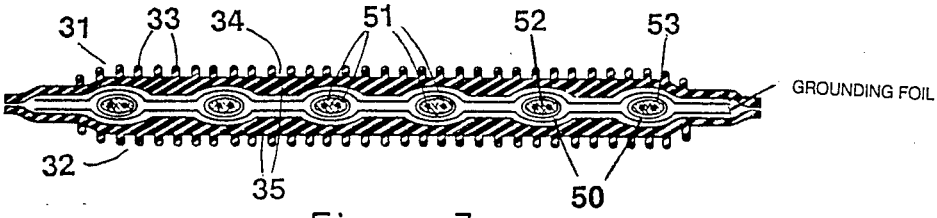
FIG. 3 is a cross section taken at 3—3 of FIG. 2, but with the parts partially exploded showing the relationship of various layers of the preferred embodiment of the mat prior to their being fully bonded together.
Figure 4:
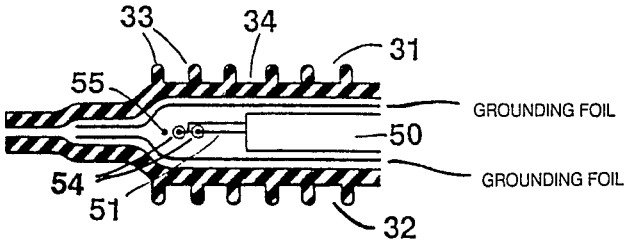
FIG. 4 is a similar cross section taken at 4—4 of FIG. 2.

The outer casing 30 of the mat has two layers forming the upper and lower exterior surfaces 31 and 32 of the mat as seen in FIG. 3. These outer layers are constructed from a suitable flexible rubber or rubberlike electrical insulating material which is also capable of providing good traction so as to prevent an individual from slipping when stepping on the surface area covered with these mats. The surfaces 31 and 32 of the mats are preferably provided with a plurality of knobby protuberances 33 over most of the surface thereof. The protuberances are spaced to provide four per inch along both the length and width of the mat. These protuberances 33 may be rounded projections or they may be frustum shaped or flattened pyramid members with the bases thereof spaced from each other and coplanar throughout the mat to provide a drainage areas 34 around and between the protuberances which drain in some direction to the edge of and off the mat surface regardless of slight inclinations of the mats on various flat surfaces to be kept clear of snow and ice. These protuberances 33 are located so that each protuberance on the top surface 31 is directly opposite a corresponding protuberance on the bottom surface 32 so that any weight borne by the mat is supported directly in a line through the protuberances of each surface, minimizing the flexing and bending of the upper and lower surfaces which would otherwise result from loads transmitted by the protuberances of the opposite surface in the areas 34 between the protuberances of either surface. Both surfaces 31 and 32 of the mats are preferably similar so that the mats can be inverted from the positions shown in FIG. 1, thus permitting the cords 6 and 7 to be located at the other side of the stair 11 or walkway 12 if that should be desirable because of a different location of the power receptacle 9.

Each of the mats has a plurality of grommets 14 uniformly spaced around the periphery of the mat for use in anchoring the mat to the surface on which it is used by any suitable means, such as nails or tacks on wooden steps.

Figure 6:
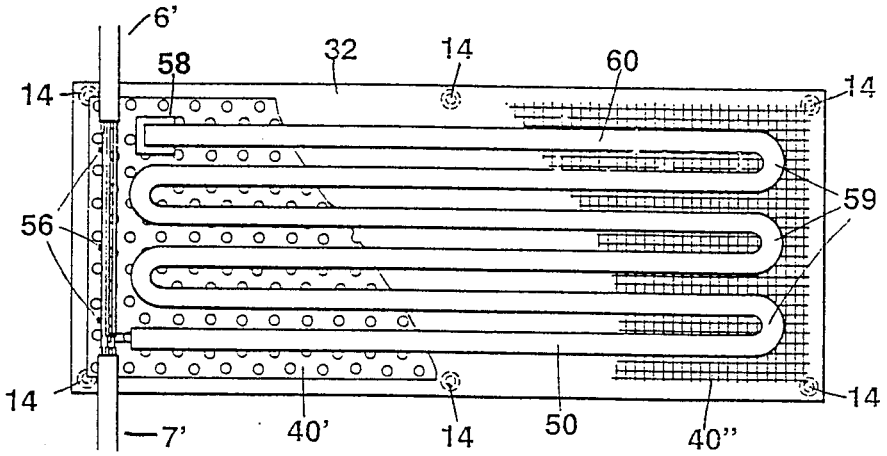
FIG. 6 is a plan view, partly broken away, showing the orientation of the electrical wiring and heating element, and illustrating two alternatives of the electrical grounding layer between the heater and the bottom outer layer of the mat.

As seen in FIG. 3, the three principal parts of the mat, outer insulating surfaces 31 and 32, grounding means 40 and heating element 50, are shown in their orientation before being pressed and bonded together. The heating strip 50 lies flat in a serpentine shape, as shown in FIG. 6. This elongated strip has a small flattened oval cross section with an electrically insulating outer sheath which encloses two closely and uniformly spaced physically parallel solid wires 51 with an electrically resistive heating material 52 between the wires 51 and extending throughout the length thereof. The serpentine shape of the heating element is formed to keep the wires 51 coplanar as seen in FIG. 3 to minimize the thickness of the mat and to provide maximum area of the resistive portion 52 of the heater strip 50 facing the outer upper 31 and lower 32 surfaces of the mat casing.

The grounding means 40 is a good conductor of heat to uniformly distribute heat from both the upper and lower surfaces of the heater strip 50 over the entire surface 31 of the mat. The outer surface of the heater strip 50 includes throughout its length a sheath of an electrically insulating material which electrically isolates the resistive material 52 and the power wires 51 from the grounding layers 40. This heat conduction facilitates transfer of heat from the lower surface of the heating strip to the upper surface 31 of the mat on which snow or ice is being melted. The grounding means has two layers 40, between the heating strip 50 and each of the upper and lower mat surfaces, 31 and 32, respectively. These layers are in good electrical and heat conductive relationship with each other over the entire area of the mat and are electrically connected to the ground conductor 55 of the main power cord which passes through each mat by, for instance, soldering or electrically bonding at numerous points 56. The grounding means 40 overlies all portions of the heater strip 50 so that any inadvertent piercing of the mat and a power wire therein by a foreign electrically conducting member would likely cause current flow to ground through ground layer which would trip the GFI system and shut off power to the mat. Even in the absence of a GFI the grounding means would still provide a path to ground for electrical current to minimize risk of damage or injury. The grounding layers conform to the periphery of the cross section of the heater strip 50 which they surround and are in good heat conductive relationship with the entire area of the heating strip. The upper layer 40 contacts at least half of the area of the strip surface and the remainder is contacted by the lower layer 40. Being a good heat conductor, the grounding means 40 also effectively spreads the heat from the electrical heating elements evenly over the top surface of the mat 31 to provide a more consistent melting effect. Furthermore as discussed in detail below, since the function of the heating element 50 is dependent on its temperature, the grounding means 40 has the effect of dissipating heat from the heating element even in the absence of snow and keeping the temperature of the element much closer to the average temperature of the entire mat surface 31, thus providing more uniformity in the operation of the electrical heating element.

Figure 10:
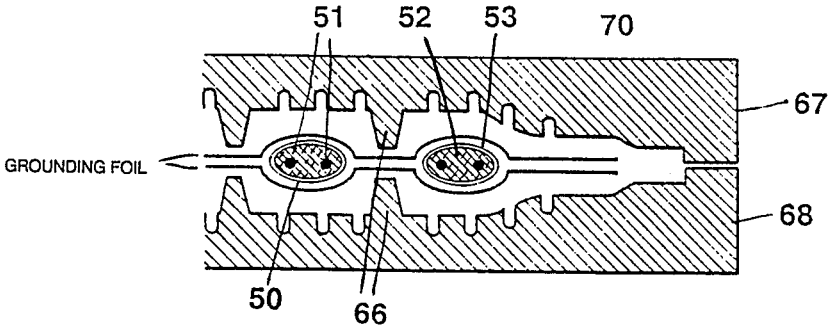
FIG. 10 is a partial cross section of an injection mold which could be used to form the mats in a single molding process showing the heater strip and grounding conductors positioned prior to molding.

The exterior electrically insulating surfaces 31 and 32 can be constructed either by injection molding the entire mat casing assembly from a liquid material or by using two preformed plies of a suitable sheet material adhered together to sandwich the internal elements as shown in FIG. 3 before the casing parts and these elements are pressed and bonded together. In order to insure drainage of the areas 34 between protuberances 33 on the upper surface 31 of the mat in use, portions of the a sheet material may have thickened sections 35 so that depressions where moisture could pool do not form on upper surface 31 between heating elements 50 in the assembled mat. A suitable material is a flexible rubber or rubberlike material which, while being an electrical insulator is a reasonably good conductor of heat. FIG. 10 shows the heater strip 50 and grounding conductors 40 positioned within the cavity 70 of an injection mold. The mold has projections 66 on the inner surfaces thereof to keep the heater strip 50 and the grounding layers 40 spaced from the mold walls to permit the material of the mat casing to essentially completely cover the area of the heater strip 50 and most of the area of the grounding layers 40. The casing holds the grounding layers 40 in intimate heat conducting relationship with the exterior of the heater. Throughout the mat the electrical grounding means 40, such as a metal sheet or foil or a screen, contacts the entire peripheral surface of the heater strip 50. The material of the grounding layers is preferably copper, but aluminum or other good heat conducting metal or heat-conducting plastic material which remains flexible and electrically conducting over the useful temperature range of the mat is acceptable. A metal foil or sheet may be perforated as shown in FIG. 6 at 40' before assembling it in the mat or a screen material 40" of approximately 8 mesh or finer may be used. The apertures in the perforated foil or the screen material enable the upper and lower layers of the casing to bond with each other through the apertures during molding or bonding of the mat assembly. A plastic material impregnated with carbon or metal particles to improve its heat and electrical conducting properties may be used. This grounding material 40 is electrically connected to the internal ground wire 55 of the mat, and may be formed to sandwich that wire, the heating element 50 and its connecting wires 54 before this sandwich is molded into the outer casing to seal the heating strip therein. This facilitates forming the conducting layers 40 above and below the heater strip 50 in intimate heat conducting contact with each other and with the entire outer surface of the heating element 50. Any air gaps or voids between the grounding layers 40 and the heating element 50 reduce the efficiency or heat transfer from the heater to the casing through the grounding layers 40.

Figure 5:
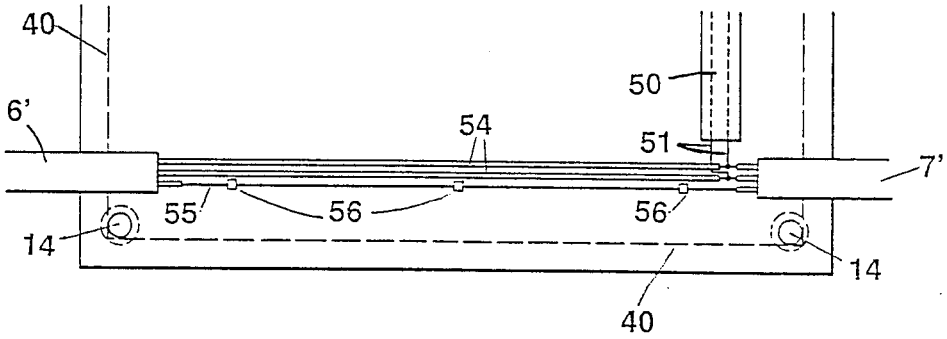
FIG. 5 is the detail of the electrical wiring of the preferred embodiment showing the electrical cords entering and exiting edges of the mat near one end at the opposite longer sides of the mat.
Figure 8:
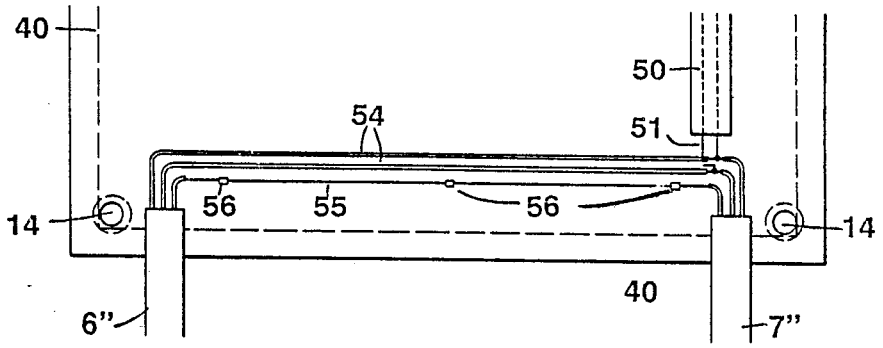
FIG. 8 is the detail of the electrical wiring of an alternative embodiment showing the electrical cords entering and exiting the mat through one end of the mat.
Figure 9:
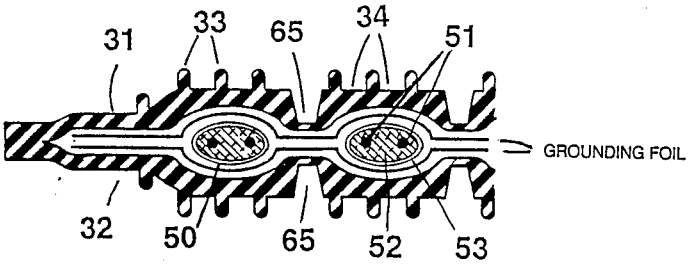
FIG. 9 is a cross section of a portion of a mat which would be created by using the injection mold of FIG. 10.

The heating strip 50 is made from a portion of a heating cable which can be cut to any desired length during manufacture of the mat. One end of this portion has the two wires 51 therein electrically connected within the mat to the two electrically insulated power wires 54, generally coplanar with the wires of the heating strip 50, which interconnect the two cords 6' and 7' or 6" and 7" within the mat as seen in FIGS. 5 and 8. The third or ground wire 55, which may be bare, runs within the mat coplanar with the other wires and is electrically connected within the mat to the grounding conductor layers 40. The electrical connections of the heater strip wires 51 to the power wires 54 seen in FIGS. 5 and 8 are potted in electrical insulating material, not shown, to isolate them from the ground conductor layers before final assembly of the mat. The unconnected end of the heating strip is covered by a small quantity of similar potting material which may be in a small electrically insulating cup 58. The electrical circuit of the heating element 50 is completed between the primary power wires 51 of the heating element within the element itself through electrically conductive material 52 which has electrical resistance which varies proportionately with its temperature as described below. The heater element primary wires 51 each need only be attached to the primary power wires 54 at a single point. This is the result of using a type of electrical heater element which incorporates electrically conductive and resistive material between two primary conductors. Such a material is sold by the Raychem Corporation of Menlo Park, Calif. under the trade name "Frostex cable." Even if a single heater element 50 should cease to conduct power the remaining heater elements, being connected in electrical parallel, would be unaffected and could continue to operate.

The resistance material of the heating element exhibits a property whereby over the useful range of temperatures, i.e. the normal outdoor environmental temperatures of below the freezing temperature of snow and ice (32 degrees F.) to approximately 100 degrees F., the resistance has a positive temperature coefficient (PTC) and may be referred to as PTC material. The heating element has physical dimensions of its small oval cross section, including its outer electrically insulating sheath, of approximately ⅛ inch thickness and ¼ inch width. Its length along its serpentine shape within the 10×20 inch mat is approximately 92 inches comprising six one foot straight portions and five semicircular arcuate bends each about four inches long. In this orientation the area of the mat surface underlain by the heating element represents slightly less than 12% of the total mat surface. Accordingly, the risk of direct contact with an electrical conductor upon piercing the mat with a foreign object is substantially less than if the electrically conducting portion of the heater element were continuous beneath the entire mat surface. The heating element may be bent in the plane of its major diameter of its oval cross section to this semicircular shape before being joined with the other parts of the mat and it will keep this preformed shape which facilitates placing and supporting it in the cavity of injection molding equipment. The heat output of the heating element is approximately 3 watts per foot at 50 degrees F. and varies generally linearly over its useful range from 6.5 watts per foot at zero degrees F. to 0.6 watts per foot at 100 degrees F. when operating at 110 volts A.C. The heater thus provides about 35 watts at 32 degrees and about 23 watts at 50 degrees F. The heat generated within the resistance material is dissipated by conduction through the heat conducting layers to the casing and to the environment, including ice and snow on the top surface of the mat. Any ice or snow on the top surface of the mat will be in the interstices between the knobby protuberances and will receive heat from the flat surfaces in these interstices as well as from the surfaces of the protuberances.

The underside of the mat is supported on the step or walkway by the tips of the protuberances so that during melting and evaporating of snow more heat will be dissipated at the upper surface of the mat than at the underside which has substantially less heat conducting area in contact with the walkway than the area in contact with snow or moisture on the upper surface. The PTC material makes the heater self protecting, without the requirement for the use of additional thermostatic switches or other temperature responsive controls, since its heat output is quite low, although sufficient to keep snow from accumulating on its upper surface. In a dry condition its heat output to the environment keeps the mat temperature and corresponding power consumption, which reach a steady state condition, at an acceptable level. Similarly, when wet the wattage output is sufficiently low to keep the mat within acceptable temperature limits. The wattage of the heating mat is also sufficiently low that the connecting wires 6 and 7 can be number 16 stranded copper wire.

The following U.S. patents assigned to Raychem Corporation and relevant to self-protecting strip heaters and conductive polymer technologies for PTC materials are incorporated herein by reference:

| | |
|---|---|
| Smith-Johannnsen et al | 3,861,029 |
| Lyons et al. | 4,188,276 |
| Batliwalla | 4,242,573 |
| Sopory | 4,318,881 |
| Toy et al. | 4,388,607 |
| Kamath et al. | 4,426,339 |
| Kamath | 4,459,473 |
| Horsma et al. | 4,560,498 |

Other variations within the scope of this invention will be apparent from the described embodiment and it is intended that the present descriptions be illustrative of the inventive features encompassed by the appended claims.

What is claimed is:

1. A flexible heating mat for preventing the accumulation of snow or ice on a walkway comprising: a flat flexible mat casing having upper and lower surfaces, a single flexible elongated heating strip of small cross section sealed within said casing, a first flexible electric cord power entering an edge of the casing near a first side thereof and generally coplanar with the mat at said edge, said first cord having a male electric plug thereon for connecting the heating strip to a source of power, said heating strip comprising two parallel closely and uniformly spaced electric conductors extending the entire length of the strip with electrically resistive material electrically interconnecting said conductors throughout said length, said cord being electrically connected to said conductors at one end of said heating strip within the mat casing, said conductors and the resistive material therebetween each having a serpentine configuration and being coplanar throughout the mat and oriented in a plane parallel to the plane of the mat when it is on a flat surface.

2. A heating mat according to claim 1 wherein said heating strip comprises a resistance heating material which has a positive temperature/resistance characteristic providing self regulation to limit the maximum temperature of the mat.

3. A heating mat according to claim 2 wherein said casing is molded about the heating strip.

4. A heating mat according to claim 2 wherein said casing includes portions which are bonded to each other to enclose and fix the position of the heating strip within the casing.

5. A heating mat according to claim 2 wherein said mat has an upper surface with portions of different height above the heater strip to provide increased surface area for heat transfer and to provide crossed drainage paths for the entire upper surface regardless of the position of the heating mat on a flat walkway surface.

6. A heating mat according to claim 2 wherein said upper surface is covered with knobby protuberances providing drainage therebetween and therearound.

7. A heating pad according to claim 2 wherein both the upper and lower surface of the mat having protuberances which are opposite each other to minimize flexing of the heating strip.

8. A heating mat for preventing the accumulation of snow or ice on a walkway comprising: a flat flexible mat casing having upper and lower surfaces, a flexible heating strip sealed within said casing, a first flexible electric cord entering an edge of the casing near a first side thereof and generally coplanar with the mat at said edge, a second electric cord entering the edge of the mat near an opposite side thereof, said cords being electrically connected to each other and to only one end of said heating strip within the mat casing, said first cord having a male electric plug thereon for connecting the heating strip to a source of power, said second cord having a female connector for connection to an electric plug like said male electric plug, the length of said second cord being less than the height of the riser of one stair step so that the female connector hangs above the next lower walkway surface when the mat is positioned on a walkway step.

9. A heating mat according to claim 8 wherein the mat may be inverted in use to permit the cords to be shifted from one end of the step to the other end while maintaining the entry point of the first cord near the edge of the mat nearest the back of the step.

10. A heating mat according to claim 8 wherein said female connector includes means for providing a weatherproof seal with a male plug connected thereto.

11. A heating mat according to claim 10 wherein said female connector has an elastic skirt opening downwardly away from the mat to tightly engage and seal against the outer surface of an electrical plug to be inserted thereinto.

12. A heating mat according to claim 8 wherein the length of said second cord is approximately one half the height of the riser of one stair step.

13. A heating mat according to claim 8 wherein said heating strip is oriented in a serpentine configuration and comprises two parallel electric conductors extending the entire length thereof with electrically resistive material therebetween, the resistance of said material having a positive temperature coefficient, said conductors being coplanar throughout the mat and oriented in a plane parallel to the plane of the mat when it is on a flat surface;

further comprising an electrically conducting grounding layer means of good heat conductivity extending in intimate heat conducting relationship and in contact with the heating strip over the entire area of the heating strip between the strip and said upper surface portion, and means for connecting said layer to an electrical ground externally of said mat.

14. A flexible heating mat for preventing the accumulation of snow or ice on a walkway comprising: a flat flexible general rectangular mat casing having upper and lower portions forming external mat surfaces, a single flexible elongated heating strip of small cross section sealed within said casing and capable of providing uniform heating over the entire area of the upper external surface of the mat, said strip comprising throughout its length an electrically insulating sheath enclosing a pair of closely and uniformly spaced electric conductors with electrically resistive material therebetween, said resistive material having a positive temperature coefficient, a first flexible electric cord entering an edge of the casing close to a corner and at a first side thereof and generally coplanar with the mat at said edge, said cord being electrically connected to each of said conductors at one end of said heating strip within the mat casing, said first cord having a male electric plug thereon for connecting the heating strip to a source of power, a second electric cord having a portion entering an edge of the casing close to a second corner thereof with the second cord portion extending from the casing generally coplanar with the mat, said second cord being electrically connected to the first cord within the mat casing, said second cord having a female connector for connection to an electric plug like said male electric plug, an electrically conducting grounding layer means of good heat conductivity extending in intimate heat conducting relationship and in contact with the outer surface of the heating strip over the entire area of the heating strip between the strip and said upper casing portion, and means for connecting said grounding layer to an electrical ground externally of said mat.

15. A heating mat according to claim 14 wherein said heating strip has a serpentine configuration, said conductors being coplanar throughout the mat and oriented in a plane parallel to the plane of the mat when it is on a flat surface.

16. A heating mat according to claim 14 wherein said grounding layer means at least partially surrounds said heating strip in good heat conducting relationship with at least half of the outer surface area of the heating strip along its entire length.

17. A heating mat according to claim 14 wherein said grounding layer means surrounds said heating strip in good heat conducting relationship with the entire outer surface area of the heating strip along its entire length.

18. A heating mat according to claim 14 wherein said grounding layer means includes a metallic foil.

19. A heating mat according to claim 14 wherein said grounding layer means includes an apertured metallic layer of good heat conducting material.

20. A heating mat according to claim 14 wherein the material of the casing penetrates apertures of the grounding layer and said upper and lower casing portions are bonded together through the apertures.

21. A heating mat according to claim 14 wherein said grounding layer is a metallic screen.

* * * * *